US006091433A

United States Patent [19]

Wen

[11] Patent Number: 6,091,433

[45] Date of Patent: Jul. 18, 2000

[54] CONTACT MICROFLUIDIC PRINTING APPARATUS

[75] Inventor: Xin Wen, Rochester, N.Y.

[73] Assignee: Eastman Kodak Company, Rochester, N.Y.

[21] Appl. No.: 08/872,909

[22] Filed: Jun. 11, 1997

[51] Int. Cl.[7] ..... B41J 2/005

[52] U.S. Cl. ..... 346/140.1; 347/5

[58] Field of Search ..... 346/140.1; 347/54, 347/5, 6; 137/55, 115.2

[56] References Cited

U.S. PATENT DOCUMENTS

| | | | |
|---|---|---|---|
| 4,072,959 | 2/1978 | Elmqvist | 347/68 |
| 4,628,330 | 12/1986 | Suga et al. | 347/54 |
| 5,178,190 | 1/1993 | Mettner . | |
| 5,238,223 | 8/1993 | Mettner et al. . | |
| 5,259,737 | 11/1993 | Kamisuki et al. . | |
| 5,367,878 | 11/1994 | Muntz et al. . | |
| 5,400,824 | 3/1995 | Gschwendtner et al. . | |
| 5,585,069 | 12/1996 | Zanzucchi et al. . | |
| 5,593,838 | 1/1997 | Zanzucchi et al. . | |
| 5,603,351 | 2/1997 | Cherukuri et al. . | |
| 5,611,847 | 3/1997 | Guistina et al. . | |
| 5,745,128 | 4/1998 | Lam et al. | 346/140.1 |

OTHER PUBLICATIONS

Dasgupta et al., "Electroosmosis: A Reliable Fluid Propulsion System for Flow Injection Analyses", Anal. Chem. 66, pp 1792–1798 (1994).

*Primary Examiner*—N. Le
*Assistant Examiner*—Lamson D. Nguyen
*Attorney, Agent, or Firm*—Raymond L. Owens

[57] ABSTRACT

A microfluidic printing apparatus responsive to an image file for printing a plurality of pixels on a display includes a plurality of ink delivery chambers; at least one ink channel for delivering ink to each ink delivery chamber; and an ink flow regulation controller (i.e., a piezo electric microvalve) for regulating the ink flow to the ink delivery chamber in response to the code values of the image file.

6 Claims, 5 Drawing Sheets

CONTACT MICROFLUIDIC PRINTING APPARATUS

CROSS REFERENCE TO RELATED APPLICATIONS

Reference is made to commonly assigned U.S. patent application Ser. No. 08/868,426, filed Jun. 3, 1997 entitled "Continuous Tone Microfluidic Printing"; U.S. patent application Ser. No. 08/868,104, filed Jun. 3, 1997 entitled "Image Producing Apparatus for Microfluidic Printing"; U.S. patent application Ser. No. 08/868,100, filed Jun. 3, 1997 entitled "Improved Image Producing Apparatus for Uniform Microfluidic Printing"; U.S. patent application Ser. No. 08/868,416, filed Jun. 3, 1997 entitled "Microfluidic Printing on Receiver"; U.S. patent application Ser. No. 08/868,477, filed Jun. 3, 1997 entitled "Microfluidic Printing With Ink Flow Regulation" and U.S. patent application Ser. No. 08/868,102, filed Jun. 3, 1997 entitled "Microfluidic Printing With Ink Volume Control" The disclosure of these related applications is incorporated herein by reference.

FIELD OF THE INVENTION

The present invention relates to contact microfluidic printing apparatus for printing a plurality of pixels.

BACKGROUND OF THE INVENTION

Microfluidic pumping and dispensing of liquid chemical reagents is the subject of three U.S. Pat. Nos. 5,585,069; 5,593,838; and 5,603,351, all assigned to the David Sarnoff Research Center, Inc., and hereby incorporated by reference. The system uses an array of reservoirs, with connecting microchannels and reaction cells etched into a substrate. Electrokinetic pumps comprising electrically activated electrodes within the capillary microchannels provide the propulsive forces to move the liquid reagents within the system. The electrokinetic pump, which is also known as an electroosmotic pump, has been disclosed by Dasgupta et al., see "Electroosmosis: A Reliable Fluid Propulsion System for Flow Injection Analyses", Anal. Chem. 66, pp 1792–1798 (1994). The chemical reagent solutions are pumped from a reservoir, mixed in controlled amounts, and then pumped into a bottom array of reaction cells. The array may be decoupled from the assembly and removed for incubation or analysis.

The above described microfluidic pumping can be used as a printing device. The fluids pumped become ink solutions comprising colorants such as dyes or pigments. The array of reaction cells may be considered ink delivery chambers to be used for picture elements, or pixels, in a display, comprising mixtures of pigments having the hue of the pixel in the original scene. When contacted with paper, the capillary force of the paper fibers draws the dye from the cells and holds it in the paper, thus producing a paper print, similar to a photograph, of the original scene.

A difficulty associated with the above described microfluidic printing is the increased complexity in fabricating microfluidic pumps. Furthermore, the flow of the inks delivered to a receiver is desirably regulated as described in the above referenced U.S. patent applications Ser. No. 08/868,477, filed Jun. 3, 1997, entitled "Microfluidic Printing With Ink Flow Regulation" and Ser. No. 08/868,102, filed Jun. 3, 1997, entitled "Microfluidic Printing With Ink Volume Control." The ink flow regulation devices require additional steps and complexities in fabrication of the microfluidic printing apparatus.

SUMMARY OF THE INVENTION

An object of this invention is to provide a contact microfluidic printing apparatus that is simple to fabricate.

An object of this invention is to provide high quality print images with reduced image defects.

These objects are achieved by a microfluidic printing apparatus responsive to an image file for printing a plurality of pixels on a display, comprising:

a) a plurality of ink delivery chambers;

b) at least one ink channel for delivering ink to each ink delivery chamber; and c) ink flow regulation means for regulating the ink flow to the ink delivery chamber in response to the code values of the image file.

ADVANTAGES

One feature of the apparatus in accordance with the present invention is that microfluidic pumps are not required in the invention apparatus.

Another feature of the apparatus in accordance with the present invention is the regulation of the ink transfer to a receiver for reducing image defects.

Another feature of the apparatus in accordance with the present invention is reduction in the clogging of the ink delivery chambers.

Still another feature of the apparatus in accordance with the present invention is that the ink pressure is controlled in the microfluidic printing apparatus.

DETAILED DESCRIPTION OF THE INVENTION

The present invention is described in relation to a contact microfluidic printing apparatus which can print computer generated images, graphic images, line art, text images and the like, as well as continuous tone images. In addition, inks are used for microfluidic printing as examples in the present applications, the invention apparatus is also applicable to other types of fluids.

Figure 1:
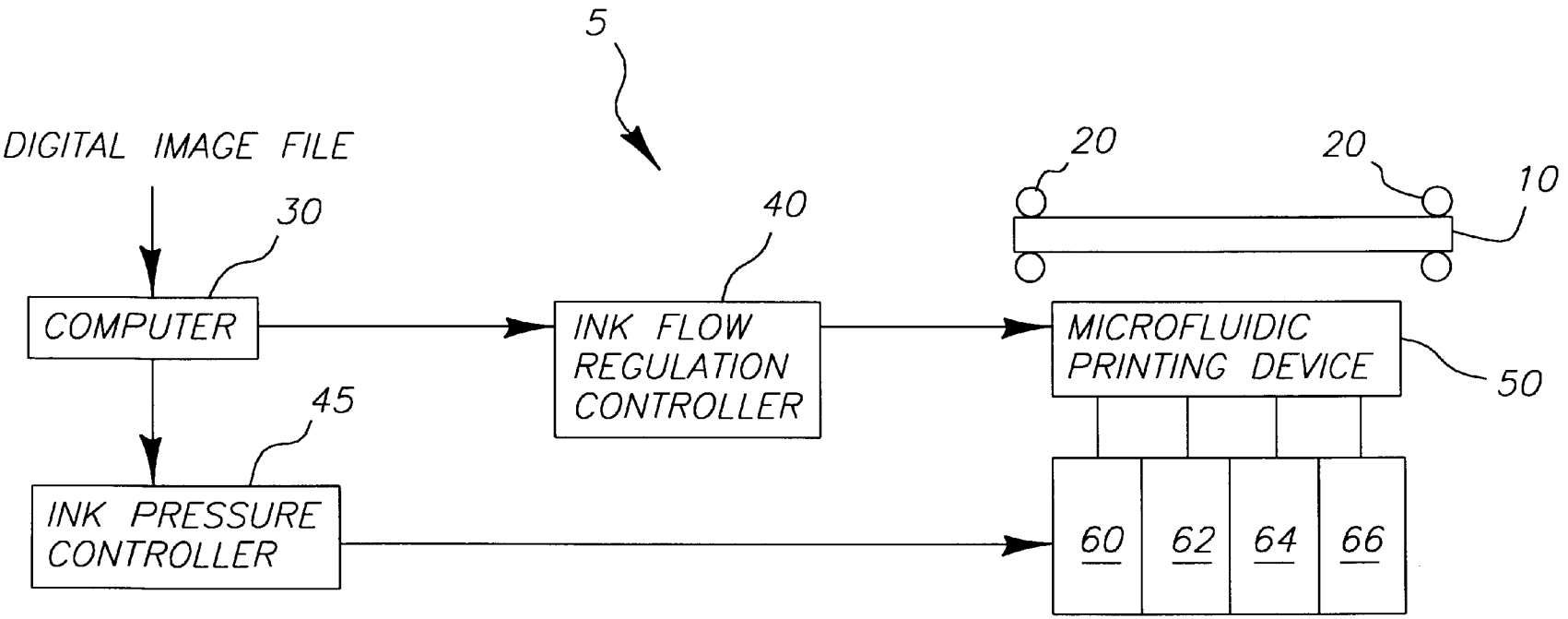
FIG. 1 is a block diagram showing a contact microfluidic printing apparatus for printing a digital image onto a receiver in the present invention.

Referring to FIG. 1, a system block diagram is shown of a contact microfluidic printing apparatus 5 in accordance with the present invention. A microfluidic printing device 50 is connected with reservoirs 60, 62, 64, and 66 that respectively provides cyan ink, magenta ink, yellow ink, and black ink. A colorless ink reservoir can also be added to vary the saturation or lightness of the inks as described in the above referenced commonly assigned U.S. patent application Ser.

No. 08/868,426, entitled "Continuous Tone Microfluidic Printing" filed Jun. 3, 1997. In accordance to an embodiment of the present invention, an ink pressure controller 45 controls the pressures in ink reservoirs 60, 62, 64, and 66. The ink pressures in the ink reservoirs can be controlled by accurately positioning the height of the top ink surfaces in the ink reservoirs. Alternately, the inks can be contained in rubber bladders. The ink pressures can be precisely controlled 45 by varying mechanical forces exerted on the rubber bladders. One advantage of the present invention is that only static (positive) pressures are required to be applied to the inks in the reservoirs. Preferably, the ink pressures are not varied during the printing procedure for each print. However, after a number of prints, the ink pressures can be adjusted to maintain the proper static ink pressures required for contact microfluidic printing. It is understood that the ink pressure controller 45 shown in FIG. 1 represents only one embodiment of the present invention. As described below, the present invention does not always require the inks to be pressurized. The ink flow can be achieved by capillary action forces in the receiver 10.

The ink flow regulation in the microfluidic printing device 50 is controlled by ink flow regulation controller 40. As described below, the ink flow can be, for example, regulated by a microvalve (220). The ink flow regulation controller is an electronic device that sends control signals that switch the microvalves from a closed position to a plurality of open positions. The duration of the microvalve 220 at each position is determined by the time separation between these control signals. Both ink flow regulation controller 40 and ink pressure controller 45 are controlled by computer 30. Finally, a reflective receiver 10 is transported by a transport mechanism 20 to come in contact with the microfluidic printing device 50. The receiver 10 receives the ink and thereby produces a print image.

Figure 2:
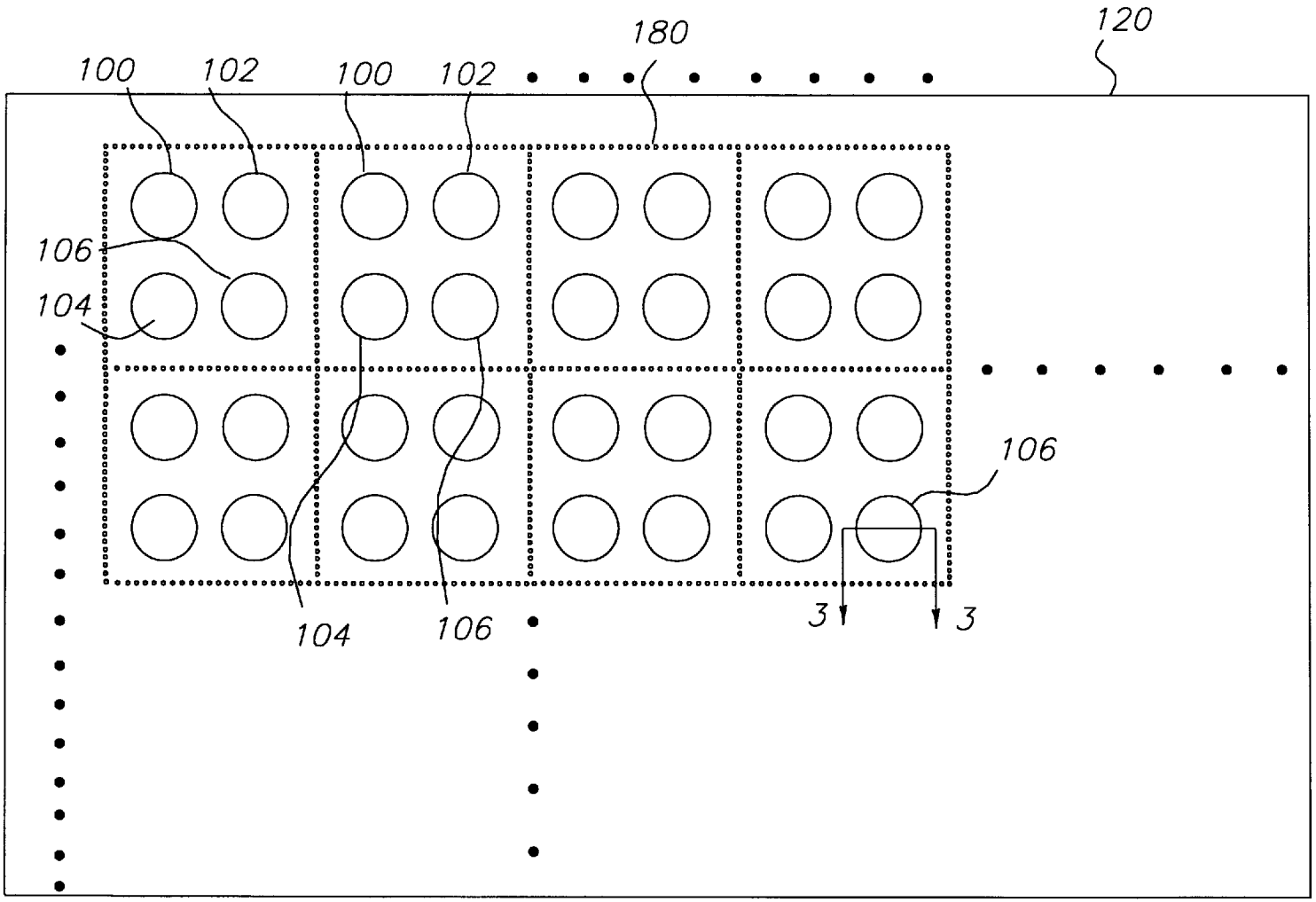
FIG. 2 is a top view of a pattern of the color pixels described in the present invention.

FIG. 2 depicts a top view of an arrangement of the ink delivery chambers 100, 102, 104, 106 respectively connected to cyan, magenta, yellow and black reservoirs 60–66. The adjacent four colored ink delivery chambers 100–106 as shown in FIG. 2 form a color pixel 180. Each of the ink delivery chambers 100–106 is connected only to the respective ink color reservoir and optionally to an additional colorless ink reservoir. When the inks are transferred to a receiver 10, some of the inks can mix and blend in the receiver. Inasmuch as the inks are in distinct areas on the receiver, the size of the printed pixels should be selected to be small enough so that the human eye will integrate the color and the appearance of the image will be that of a continuous tone photographic quality image.

In an alternate arrangement, microchannels for several colored inks can be connected to one ink mixing chamber as described in the above referenced commonly assigned U.S. patent application Ser. No. 08/868,426, filed Jun. 3, 1997, entitled "Continuous Tone Microfluidic Printing."

The inks used in this invention are dispersions of colorants in common solvents. Examples of such inks may be found is U.S. Pat. No. 5,611,847 by Gustina, Santilli, and Bugner. Inks may also be found in the following commonly assigned U.S. patent application Ser. Nos. 08/699,955, 08/699,962, and 08/699,963, all filed Aug. 20, 1996 by McInerney, Oldfield, Bugner, Bermel, and Santilli; Ser. No. 08/790,131, filed Jan. 29, 1997 by Bishop, Simons, and Brick; and Ser. No. 08/764,379, filed Dec. 13, 1996 by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. The colorless ink of this invention is the solvent for the colored inks in the most preferred embodiment of the invention.

Figure 3:
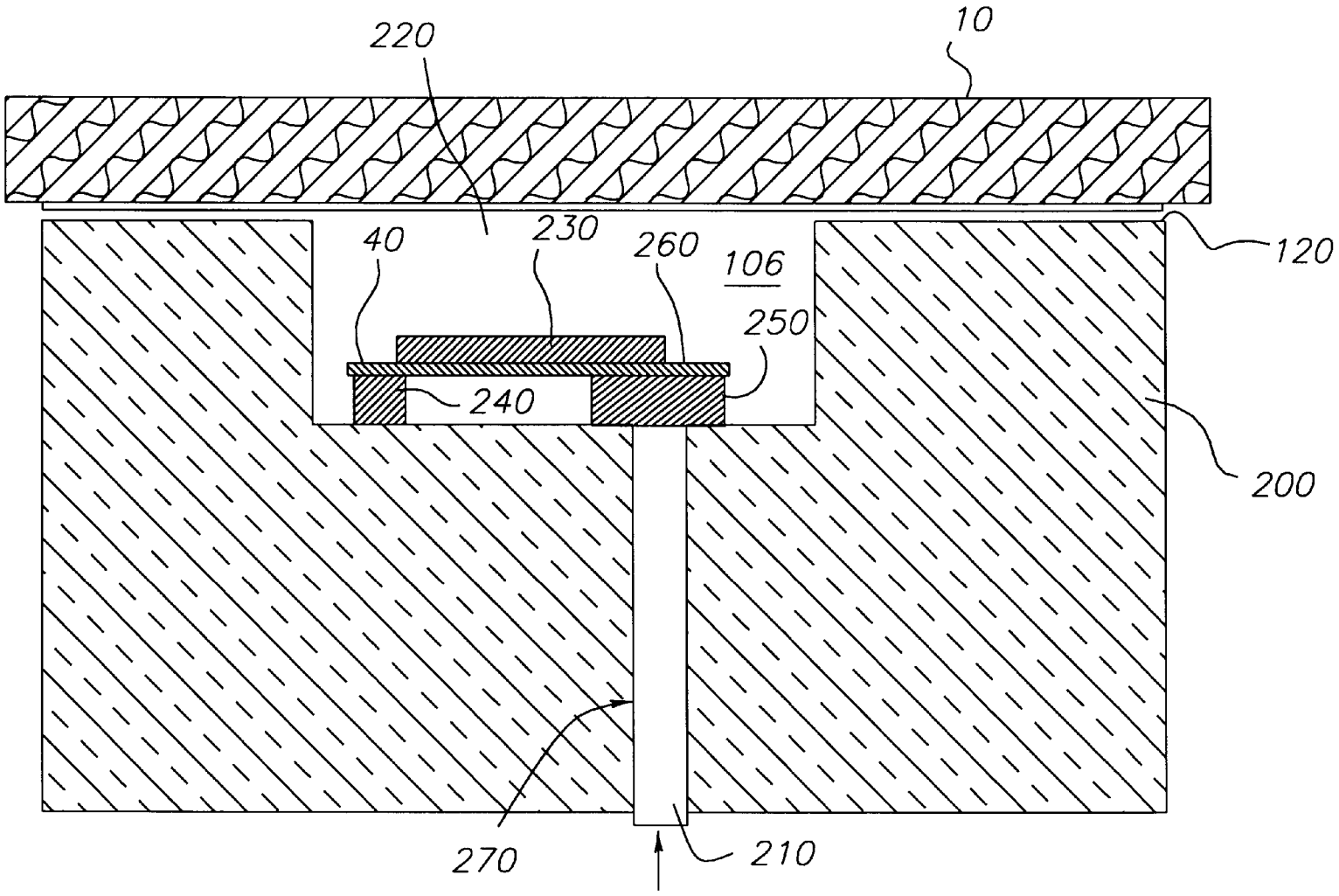
FIG. 3 is a cross-sectional view taken along the lines 3—3 of the black ink delivery chamber in the contact microfluidic printing apparatus in FIG. 2 showing the microvalve 220 in closed position.

The colored ink deliver chambers 60–66 have similar structures. A black ink delivery chamber is described as an example. FIG. 3 shows a cross-sectional view of a black ink delivery chamber in the contact microfluidic printing apparatus taken along the lines 3—3 in FIG. 2. On a substrate 200 is fabricated the black ink delivery chamber 106, a microvalve 220 and microchannel 270. The substrate can be made of semiconductor such as silicon, glass, or metallic materials. The microchannels 270 is connected to the black ink reservoir 66 which provides black ink 210 to the black ink delivery chamber 106. A microbeam 260, supported by a pivotal support 240, is attached to a boss 250 which serves as a shutter to the microchannel 210. The microbeam 260 is attached to the piezo plate 230 which is controlled by electric signals from ink flow regulation controller 40 that is further controlled by computer 30 (FIG. 1). The electric signals from ink flow regulation control 40 control the deflection of the microbeam 260 and thus can switch the boss 250 (shutter) from a close position and a plurality of open positions. The time of the microvalve 220 spent at each position is determined by the duration between these control signals. A receiver 10 is transported by transport mechanism 20 to be in close vicinity to the front plate 120. FIG. 1 shows the microvalve 220 in a closed position. The black ink delivery chamber 210 is blocked from the black ink delivery chamber 106. Details of the calculation of the ink flow regulation parameters are described below.

Figure 4:
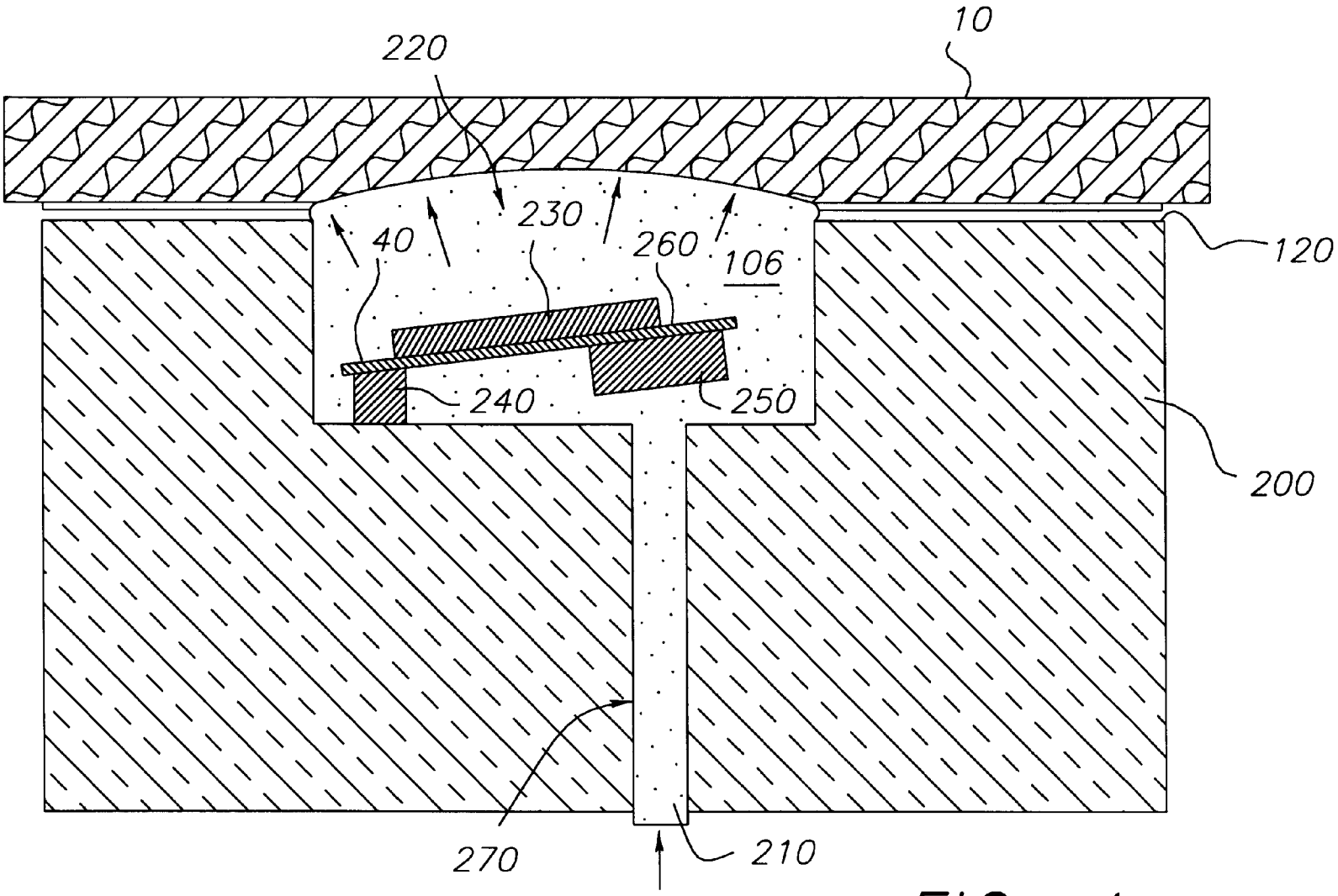
FIG. 4 is another cross-sectional view of the black ink delivery chamber in the microfluidic printing apparatus similar to FIG. 3 showing the microvalve 220 in an open position.

FIG. 4 shows another cross-sectional view of the same black ink delivery chamber 106 when the microvalve 220 is in a second and open position. The black ink 210 is shown to flow into the black ink delivery chamber 106 and diffuse into the receiver 10 that is adjacent to the front plate 120. The ink flow is terminated when the microvalve 220 is switched back to the close position as shown in FIG. 3 after the correct amount of ink is delivered. The microvalve 220 can be controlled by ink flow regulation controller 40 to several open-valve positions which provide different degree of openings that regulates the flow or amount of the black ink 210 delivered to a delivery chamber.

Many other types of ink regulation means can be used for the present invention. One example is a microvalve comprising a bimetallically driven diaphragms as described in p26 Sensor, September, 1994. Other examples of regulators are described in U.S. Pat. Nos. 5,178,190, 5,238,223, 5,259,737, 5,367,878, and 5,400,824.

Although one color ink channel is shown to be connected with each color ink delivery channel in FIGS. 3 and 4, more than one color ink channels can be connected to an ink delivery channel in accordance to the present invention. The colored inks can be mixed in the ink delivery chamber prior to being transferred to a receiver. A colorless ink reservoir can also be added to vary the saturation or lightness of the inks.

Figure 5:
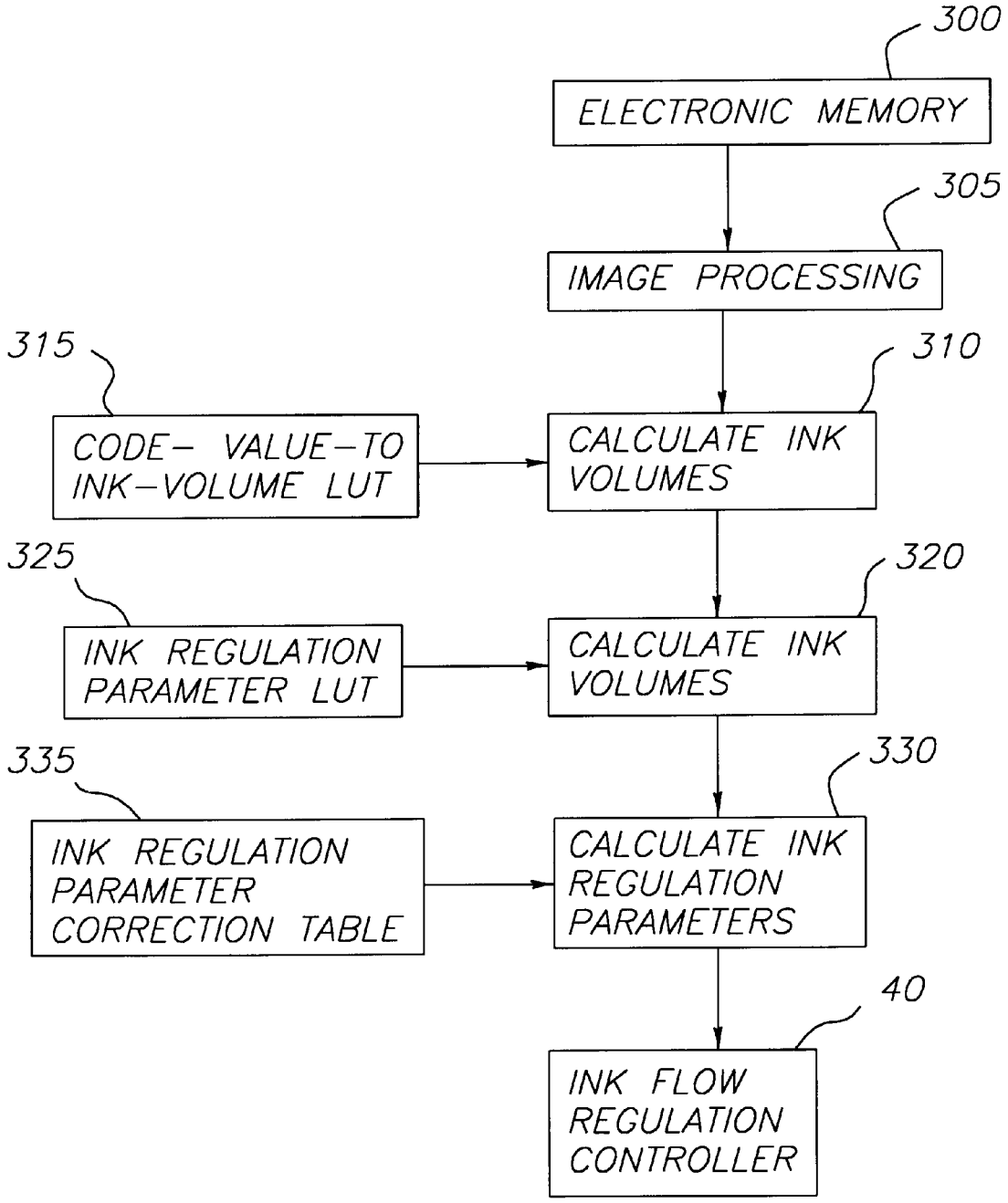
FIG. 5 is a flow diagram of the printing operations by the contact microfluidic printing apparatus 5 in FIG. 1.

A typical printing operation in the present invention is shown in FIG. 5. A digital image file, which can be applied an input to microcomputer 30, is stored in an electronic memory block 300. Alternatively, the image file can be produced by the microcomputer 30 or provided as an input from a magnetic disk, a compact disk (CD), a memory card, a magnetic tape, a digital camera, a print scanner, or a film scanner, and the like. The image file can exist in many formats such as a page-description language or a bitmap format such as Postscript, JPEG, TIF, Photoshop, and so on.

Next, the image file is processed, in block 305, which can include the following operations: decoding; decompression; rotation; resizing; coordinate transformation; mirror-image transformation (for printing on receiver media); tone scale adjustment; color management; multi-level halftoning (or multitoning); code-value conversion; rasterization; and other operations. The output image file from block 305 includes a plurality of spatial pixels described by color code values with the pixels corresponding to ink delivery chambers 100–106 (FIG. 2) or full color pixel as described above.

Still referring to FIG. 5, the ink volumes to be delivered to the receiver 10 are calculated in block 310 according to the code values for each spatial pixel with the assistance of the code-value-to-ink-volume look-up table (LUT) in block 315. Details about block 310 and methods for producing block 310 are exemplified in the above referenced and commonly assigned U.S. patent application Ser. No. 08/868,104, filed Jun. 3, 1997, entitled "Improved Image Producing Apparatus for Microfluidic Printing." Next the ink regulation parameters are calculated in block 320 for each colored ink corresponding to each of the ink delivery chambers 100–106 using the ink regulation parameter LUT (look-up table) in block 325. The ink regulation parameters include the close and the multiple open positions for the microvalve 220 and the durations corresponding to each position. The ink regulation parameter LUT in block 325 lists the ink regulation parameters required for each calculated delivering ink volumes.

Next in block 330 the regulation parameters are corrected in block 330 for compensating the variabilities between each ink delivery channels 100–106 using the ink regulation parameter correction table in block 335. Detailed steps of correcting ink regulation parameters in block 330 and producing the ink regulation parameter correction table of block 335 are exemplified by the steps for correcting pump parameters described in the above referenced and commonly assigned U.S. patent application Ser. No. 08/868,104, filed Jun. 3, 1997, entitled "Improved Image Producing Apparatus for Uniform Microfluidic Printing". Finally the computer 30 delivers the ink regulation parameters to ink flow regulation controller 40.

In the non-printing mode, the microvalve 220 is closed as shown in FIG. 3. The inks in the ink delivery channels 270 are blocked from the ink delivery chambers 100–106. This prevents ink solutions from drying up at the outlets of the microchannels which often causes kogation problems in the microchannels. The colored inks in the ink reservoirs 60–66 are applied with static and positive pressures as described above. The printing operation starts when the computer 30 sends computed ink regulation parameters to ink flow regulation controller 40 as described above. The selected microvalves 220 are opened by the deflection of the piezo plates 230 as shown in FIG. 4. The inks flow incrementally into ink delivery chambers 100–106. The inks in each delivery chamber are mixed. After the correct amount of mixed ink is in each delivery chamber, a receiver 10 is moved into contact with such chambers. The colored inks diffuse into the receiver 10. The adjacent colored inks in the receiver 10 form a color pixel 180 according to the input digital image file. After the correct amount of inks are delivered, as calculated in blocks 320 and 330, the microvalves 220 are switched back to the closed position as shown in FIG. 3.

In an alternate arrangement of the present invention, the positive pressure is not applied to the ink fluids. The ink fluids flow into the ink delivery chambers 60–66 as driven by the capillary forces in the porous structure in the receiver 10 for a period, in which the microvalve 220 is open, as computed as above described.

Because the ink flow to the receiver 10 can be shut off, the requirement on the receiver type is much relaxed. This feature permits a wide variety of receivers to be usable in the invention printing apparatus. Such receivers include common bond paper, made from wood fibers, as well as synthetic papers made from polymeric fibers. The receivers can also be of non-fibrous construction, provided they absorb and hold the ink used in the printer. In addition, the present invention apparatus can also desirably use saturable receivers as described in the above referenced and commonly assigned U.S. patent application Ser. No. 08/868,416, filed Jun. 3, 1997, entitled "Microfluidic Printing on Receiver."

The invention has been described in detail with particular reference to certain preferred embodiments thereof, but it will be understood that variations and modifications can be effected within the spirit and scope of the invention.

PARTS LIST

5 contact microfluidic printing apparatus
10 receiver
20 transport mechanism
30 computer
40 ink regulation controller
45 ink pressure controller
50 microfluidic printing device
60 cyan ink reservoir
62 magenta ink reservoir
64 yellow ink reservoir
66 black ink reservoir
100 magenta ink delivery chamber
102 magenta ink delivery chamber
104 yellow ink delivery chamber
106 black ink delivery chamber
120 printer front plate
180 color pixel
200 substrate
210 black ink
220 microvalve
230 piezo plate
240 pivotal support
250 boss
260 microbeam
270 microchannel
300 electronic memory PARTS LIST (con't)

305 image processing
310 calculate ink volumes
315 code value to ink volume LUT
320 calculate ink regulation parameters
325 ink regulation parameter LUT
330 correct regulation parameters
335 ink regulation correction table

What is claimed is:

1. A microfluidic contact printing apparatus responsive to an image file for printing a plurality of pixels on a receiver, comprising:

a) a plurality of ink reservoirs;

b) a plurality of ink delivery chambers for transferring ink in continuous flow to the receiver;

c) at least one ink channel providing communication between an ink delivery chamber and an ink reservoir;

d) ink pressure controller means for pressurizing inks in each channel for ink delivery to the delivery chambers;

e) ink flow regulation means including a plurality of microvalves moveable between open and closed positions for regulating the ink flow to the ink delivery chambers, each microvalve including a microbeam and a piezoelectric plate coupled to the microbeam for controlling the positions of the microbeam corresponding to the open and closed positions of the microvalve; and f) means for controlling the ink flow regulation means in response to the code values of the image file by causing the piezoelectric plates to control the positions of the microbeams.

2. A microfluidic contact printing apparatus responsive to an image file having code values for printing a plurality of colored pixels with colored liquid inks on a receiver, comprising:

a) a plurality of ink reservoirs for supplying different colored liquid inks;

b) a plurality of ink delivery chambers for transferring the colored inks in continuous flows to the receiver;

c) ink channels providing communication between an ink delivery chamber and the ink reservoirs;

d) ink pressure controller means for pressurizing inks in each channel for delivering ink to selected ink delivery chambers;

e) ink regulation microvalves for regulating the ink flow from selected ink reservoirs to the ink delivery chambers where the colored inks are mixed, each microvalve being moveable from a closed position to an open position for regulating the amount of ink flow; and f) computing means for controlling the ink pressure controlling means and the open and closed positions of each microvalve in response to the code values of the image file to regulate the colored inks and their flow into the ink delivery chambers for printing different colored pixels.

3. The apparatus of claim 2 wherein the microvalve includes piezoelectric means effective in a first position for blocking the flow of ink and in a plurality of second positions for regulating the amount of ink transferred to the receiver in response to code values.

4. The apparatus of claim 3 wherein the ink reservoirs store different colored inks and such inks are mixed in the ink delivery chambers.

5. The apparatus of claim 2 wherein the computing means further controls the duration of each microvalve at its open position.

6. The apparatus of claim 2 wherein the microvalve has a plurality of open positions and the computing means selects the open position of each microvalve and controls the duration of each microvalve at its selected open position.

* * * * *